US007387097B2

(12) United States Patent
Schmitt et al.

(10) Patent No.: US 7,387,097 B2
(45) Date of Patent: Jun. 17, 2008

(54) INA-SCHAEFFLER KG, INDUSTRIESTRASSE 1-3, 91074 HERZOGENAURACH ANR 12 88 48 20

(75) Inventors: Marco Schmitt, Fulda (DE); Jochen Auchter, Weisendorf (DE)

(73) Assignee: Ina-Schaeffler JG, Herzogenaurach (DE)

( * ) Notice: Subject to any disclaimer, the term of this patent is extended or adjusted under 35 U.S.C. 154(b) by 273 days.

(21) Appl. No.: 11/243,906

(22) Filed: Oct. 5, 2005

(65) Prior Publication Data

US 2007/0062475 A1 Mar. 22, 2007

(51) Int. Cl.
*F01L 1/34* (2006.01)

(52) U.S. Cl. ..... 123/90.17; 123/90.12; 123/90.15; 123/347; 464/160

(58) Field of Classification Search ..... 123/90.15, 123/90.16, 90.17, 90.18, 90.13, 347, 348, 123/90.12; 464/1, 2, 160
See application file for complete search history.

(56) References Cited

U.S. PATENT DOCUMENTS 7,261,072 B2 * 8/2007 Schmitt ..... 123/90.15

FOREIGN PATENT DOCUMENTS

| | | |
|---|---|---|
| DE | 195 11 787 | 10/1995 |
| DE | 198 54 891 | 6/1999 |
| DE | 101 11 419 | 9/2001 |

* cited by examiner

*Primary Examiner*—Ching Chang
(74) *Attorney, Agent, or Firm*—Charles A. Muserlian

(57) ABSTRACT

The invention relates to a device (101) for varying the control times of gas exchange valves of an internal combustion engine, with a hydraulic actuation device (102) and with a control valve (103). The device (101) according to the invention is provided with mid-position locking of a hydraulic actuation device (102). Furthermore, the device (101) according to the invention ensures that, in the event of the failure of an actuation unit (112) which regulates the control valve (103), the hydraulic actuation device (102) is locked in the mid-position and the lock is maintained until the actuation unit (112) is repaired. Furthermore, the device (101) according to the invention makes it possible to start the internal combustion engine in a position locked in a mid-position, without a movable element (105) of the hydraulic actuation device (102) butting against a side wall of a pressure space (104) when the internal combustion engine is started. Methods are proposed to bring the actuation device (102) into a locked mid-position, and to hold it there, for the restarting of the internal combustion engine.

3 Claims, 6 Drawing Sheets

**INA-SCHAEFFLER KG,
INDUSTRIESTRASSE 1-3, 91074
HERZOGENAURACH ANR 12 88 48 20**

FIELD OF THE INVENTION

The invention relates to a device for varying the control times of gas exchange valves of an internal combustion engine according to the precharacterizing clauses of Claims 1, 2 and 3.

In internal combustion engines, camshafts are used for actuating the gas exchange valves. Camshafts are mounted in the internal combustion engine in such a way that cams attached to them bear against cam followers, for example bucket tappets, drag levers or rocker arms. When a camshaft is set in rotation, the cams roll on the cam followers which, in turn, actuate the gas exchange valves. Thus, by virtue of the position and shape of the cams, both the opening duration and the opening amplitude, but also the opening and closing time points of the gas exchange valves are defined.

Modern engine concepts tend towards a variable design of the valve drive. On the one hand, the valve stroke and valve-opening duration are to be capable of a variable configuration up to the complete cut-off of individual cylinders. For this purpose, concepts, such as switchable cam followers or electrohydraulic or electrical valve actuations, are provided. Furthermore, it has proved advantageous to be able to influence the opening and closing times of the gas exchange valves while the internal combustion engine is in operation. In this case, in particular, it is desirable to be able to influence the opening and closing time points of the inlet and outlet valves separately, for example in order to set a defined valve overlap in a controlled way. By the opening and closing time points of the gas exchange valves being set as a function of the current characteristic diagram range of the engine, for example of the current rotational speed or of the current load, the specific fuel consumption can be lowered, exhaust-gas behaviour can be influenced positively and the engine efficiency, maximum torque and maximum power can be increased.

The described variability of the valve control times is achieved by means of a relative change in the phase position of the camshaft with respect to the crankshaft. In this case, the camshaft is drive-connected to the crankshaft mostly via a chain, belt or gearwheel drive or drive concepts acting in the same way. Between the chain, belt or gearwheel drive driven by the crankshaft and the camshaft, a device for changing the control times of an internal combustion engine, also referred to below as a camshaft adjuster, is mounted, which transmits the torque from the crankshaft to the camshaft. In this case, this device is designed in such a way that the phase position between crankshaft and camshaft is reliably maintained while the internal combustion engine is in operation and, if desired, the camshaft can be rotated with respect to the crankshaft within a certain angular range.

In internal combustion engines with a camshaft in each case for the inlet and the outlet valve, these may be equipped in each case with a camshaft adjuster. As a result, the opening and closing time points of the inlet and outlet valves can be shifted in time in relation to one another and the valve overlaps can be set in a controlled way.

The seat of modern camshaft adjusters is mostly located at the drive-side end of the camshaft. However, the camshaft adjuster may also be arranged on an intermediate shaft, a non-rotating component or the crankshaft. It consists of a driving wheel driven by the crankshaft and maintaining a fixed phase relation with respect to the latter, of a driven part drive-connected to the camshaft and of an adjustment mechanism transmitting the torque from the driving wheel to the driven part. As regards a camshaft adjuster not arranged on the crankshaft, the driving wheel may be designed as a chain wheel, belt wheel or gearwheel and is driven by the crankshaft by means of a chain, belt or gearwheel drive. The adjustment mechanism may be operated electrically, hydraulically or pneumatically.

Two preferred embodiments of hydraulically adjustable camshaft adjusters are what are known as the axial-piston adjusters and rotary-piston adjusters.

Where the axial-piston adjusters are concerned, the driving wheel is connected to a piston and the latter is connected to the driven part, in each case via helical toothings. The piston separates a cavity formed by the driven part and the driving wheel into two pressure chambers arranged axially with respect to one another. If, then, one pressure chamber is acted upon by pressure medium, whilst the other pressure chamber is connected to a tank, the piston is displaced in the axial direction. The axial displacement of the piston is converted by means of the helical toothings into a relative rotation of the driving wheel with respect to the driven part and consequently of the camshaft with respect to the crankshaft.

Rotary-piston adjusters, as they are known, form a second embodiment of hydraulic camshaft adjusters. In these, the driving wheel is connected fixedly in terms of rotation to a stator. The stator and a rotor are arranged concentrically with respect to one another, the rotor being connected to a camshaft, an extension of the camshaft or an intermediate shaft non-positively, positively or in a materially integral manner, for example by means of a pressfit, a screw connection or a welded joint. In the stator, a plurality of cavities are formed, which are spaced apart in the circumferential direction and, starting from the rotor, extend radially outwards. The cavities are delimited in a pressure-tight manner in the axial direction by means of side covers. A vane connected to the rotor extends into each of these cavities and divides each cavity into two pressure chambers. By the individual pressure chambers being connected in a controlled way to a pressure-medium pump or to a tank, the phase of the camshaft in relation to the crankshaft can be set or maintained.

To control the camshaft adjuster, sensors detect the characteristic data of the engine, such as, for example, the load state and the rotational speed. These data are fed to an electronic control unit which, after comparing the data with a characteristic data diagram of the internal combustion engine, controls the inflow and the outflow of pressure medium to and from the various pressure chambers.

In order to adjust the phase position of the camshaft with respect to the crankshaft, in hydraulic camshaft adjusters one of the two reciprocally acting pressure chambers of a cavity is connected to a pressure-medium pump and the other to the tank. The inflow of pressure medium to one chamber, in conjunction with the outflow of pressure medium from the other chamber, displaces in the axial direction the piston separating the pressure chambers, with the result that, in axial-piston adjusters, the camshaft is rotated in relation to the crankshaft via the helical toothings. In rotary-piston adjusters, by one chamber being acted upon by pressure and the other chamber being relieved of pressure, a displacement of the vane and consequently, directly, a rotation of the camshaft with respect to the crankshaft are brought about. In order to maintain the phase position, both pressure chambers either are connected to the pressure-medium pump or are separated both from the pressure-medium pump and from the tank.

The control of the pressure-medium streams to and from the pressure chambers takes place by means of a control valve, usually a 4/3-way proportional valve. A valve housing is provided in each case with a connection for the pressure chambers (working connection), with a connection to the pressure-medium pump and with at least one connection to a tank. Within the valve housing of essentially hollow-cylindrical design is arranged an axially displaceable control piston. The control piston can be brought axially into any position between two defined end positions, counter to the spring force of a spring element, by means of an electromagnetic actuator. Furthermore, the control piston is provided with annular grooves and control edges, with the result that the individual pressure chambers can be connected selectively to the pressure-medium pump or to the tank. A position of the control piston may likewise be provided, in which the pressure-medium chambers are separated both from the pressure-medium pump and from the pressure-medium tank.

A device of this type is illustrated in DE 100 64 222 A1. This is a device of the rotary-piston type of construction. A stator drive-connected to the camshaft is mounted rotatably on a rotor connected fixedly in terms of rotation to a camshaft. The stator is designed with recesses open to the rotor. Side covers which delimit the device are provided in the axial direction of the device. The recesses are closed off in a pressure-tight manner by means of the rotor, the stator and the side covers and thus form pressure spaces. Introduced into the outer surface area of the rotor are axial grooves, in which are arranged vanes extending into the recesses. The vanes are designed in such a way that they divide the pressure spaces in each case into two reciprocally acting pressure chambers. By pressure medium being supplied to and discharged from the pressure chambers, the phase position of the camshaft in relation to the crankshaft can be selectively maintained or adjusted.

In the side covers are arranged two locking pins which are acted upon with a force in the direction of the rotor by a spring means. Grooves extending in the circumferential direction are introduced into that end face of the rotor which faces the locking pins. The grooves are arranged and designed in such a way that, in a defined middle position, the two locking pins engage in each case into a groove when none of the grooves is acted upon by a pressure medium. In this case, each pin bears against a circumferential end of the respective groove. The rotor is thus locked in relation to the stator, with the result that a relative rotation is prevented. The pressure-medium chambers can be filled with pressure medium via first and second pressure-medium lines. When a first pressure-medium chamber is filled with pressure medium, one end face of a locking pin is likewise acted upon by pressure medium. The corresponding pin is thereby pressed into the reception bore of the side cover, and an adjustment of the rotor in relation to the stator in one direction becomes possible. In this case, the other groove, into which the other locking pin is also engaged, is designed in such a way that an adjustment of the rotor from the middle position as far as a maximum value becomes possible. The adjustment of the rotor with respect to the stator takes place correspondingly in the other direction. The device is equipped with a compensation spring which is fastened at one end to the rotor and at its other end to the stator and which compensates the drag torque which the camshaft exerts on the rotor.

In DE 198 53 670 A1, a control valve is illustrated which serves for controlling the pressure-medium flow to the pressure chambers as a function of the current load state of the internal combustion engine. The control valve consists of an actuation unit, of a valve housing of essentially hollow-cylindrical design and of a control piston which is of essentially hollow-cylindrical design and which is received axially displaceably within the valve housing. Two working connections, an inflow and an outflow connection, are formed on the valve housing. The actuation unit may be, for example, an electromagnet which, by the application of a control current, displaces the control piston, counter to the force of a spring, via a tappet push rod. As a function of the position of the control piston within the valve housing, the inflow connection is connected to one of the two working connections and the tank connection to the other working connection in each case or the working connections are separated from the inflow or the outflow connection. Pressure medium is thereby supplied to one pressure chamber, whilst pressure medium flows out of the other pressure chamber, thus bringing about a variation in the phase position of the camshaft with respect to the crankshaft.

A serious disadvantage of this control valve, in conjunction with a camshaft adjuster having mid-position locking, is that, in the dead state, the pressure-medium connection is connected to one of the two working connections. In the event of a malfunction of the actuator, therefore, pressure medium is conducted to one of the two pressure chambers and at the same time to one of the two pins. As a result, depending on the configuration of the control valve, the camshaft adjuster is rotated into one of the two maximum positions after the failure of the actuation unit, and this phase position is maintained for the entire operation of the internal combustion engine. Since the mid-position in which the camshaft adjuster is locked when the device is in a pressureless state is selected such that the internal combustion engine has good starting and running properties in this phase position of the camshaft in relation to the crankshaft, a maximum phase shift in relation to the mid-position results in poorer starting and running properties of the internal combustion engine.

SUMMARY OF THE INVENTION

The object on which the invention is based is, therefore, to avoid these outlined disadvantages and therefore to propose a method, by means of which the camshaft can be brought in relation to the crankshaft into a phase position in which the hydraulic actuation device is in a position either in which the latter is locked or in which the latter is brought automatically into the locking position during the first revolution of the camshaft in the event of a new start, without a piston or vane butting against a limit stop.

Furthermore, a method is to be proposed whereby the actuation device is brought into the locking position in the case of a non-locked stopping position.

In a first method according to the precharacterizing clause of Claim 1, the object is achieved, according to the invention, in that the following method steps are carried out in the order listed:

- assumption and holding of a defined phase position $\phi+X^{o}KW$,
- switch-off of the ignition,
- setting of the second or fourth control position (130, 132) in order to hold the phase position $\phi+X^{o}KW$ until the rotational-speed sensor arrangement communicates the rotational speed n=0, detection of the rotational speed n via a rotational-speed sensor arrangement, holding of the assumed control position (130, 132) for a predetermined time span, after the expiry of the time span, deactivation of the actuation unit (112).

By means of this method, the actuation device is brought, during the stopping operation, into a phase position which deviates by an amount X° crankshaft (KW) from the centre locking position. The sign of X depends on the direction of adjustment of the actuation device if this is not yet sufficiently filled with pressure medium. If, for example, the device is equipped with no compensation spring or with a compensation spring which exerts a low torque on the rotor/stator system, the torque being lower than the drag torque of the rotating camshaft, then this phase position is advanced in relation to the centre locking position. In the event that the compensation-spring torque is higher than and opposite to the camshaft drag torque, this phase position is retarded in relation to the centre locking position by means of the method steps. After the ignition has been switched off, that control position is to be assumed which prevents the actuation unit from moving into the mid-position until a rotational-speed sensor arrangement communicates the rotational speed n=0. The assumed control position is subsequently held for the defined timespan. This is necessary, since the rotational-speed sensor arrangement communicates the rotational speed n=0 even in the last revolution of the camshaft/crankshaft, and, because of the alternating torques, the actuation unit may be displaced beyond the mid-position into the undesired position. By means of this holding time, relaxation effects of the internal combustion engine are likewise absorbed, for example the depressurization of the piston or the like, with the result that the wrong position may likewise be assumed.

In a second method according to the precharacterizing clause of claim 2, the object is achieved, according to the invention, in that the following method steps are carried out in the order listed during the stopping operation:

assumption and holding of a defined phase position $\phi+X^{o}KW$, switch-off of the ignition, setting of the second or fourth control position (130, 132) in order to hold the phase position $\phi+X^{o}KW$ until the rotational-speed sensor arrangement communicates the rotational speed n=0, detection of the rotational speed n via a rotational-speed sensor arrangement, holding of the assumed control position (130, 132) for a predetermined time span, after the expiry of the time span, deactivation of the actuation unit (112), and in that the following method steps are carried out in the order listed during the starting operation:

setting of the first control position, detection of the rotational speed n of the crankshaft or of the camshaft, if the rotational speed is n>0: detection of the pressure-medium pressure p, if the pressure-medium pressure p is higher than a predetermined value: setting of control positions according to the characteristic diagram filed in the control unit.

This ensures that locking is achieved in the unlocked state and locking can be cancelled only when the pressure-medium pressure has reached a specific value and therefore a sufficient supply of pressure medium to the device is ensured. A butting of a piston or vane is thereby prevented, which would be the case in the event that the device were not locked and not supplied with sufficient pressure medium.

In a third method according to the precharacterizing clause of Claim 3, the object is achieved, according to the invention, in that the following method steps are carried out in the order listed:

setting of the first control position detection of the rotational speed n of the crankshaft or of the camshaft if the rotational speed is n>0: detection of the pressure-medium pressure p, if the pressure-medium pressure p is higher than a predetermined value: setting of control positions according to the characteristic diagram filed in the control unit.

BRIEF DESCRIPTION OF THE DRAWINGS

Further features of the invention may be gathered from the following description and from the drawings which illustrate exemplary embodiments of the invention in simplified form and in which.

DETAILED DESCRIPTION OF THE DRAWING

Figure 1:
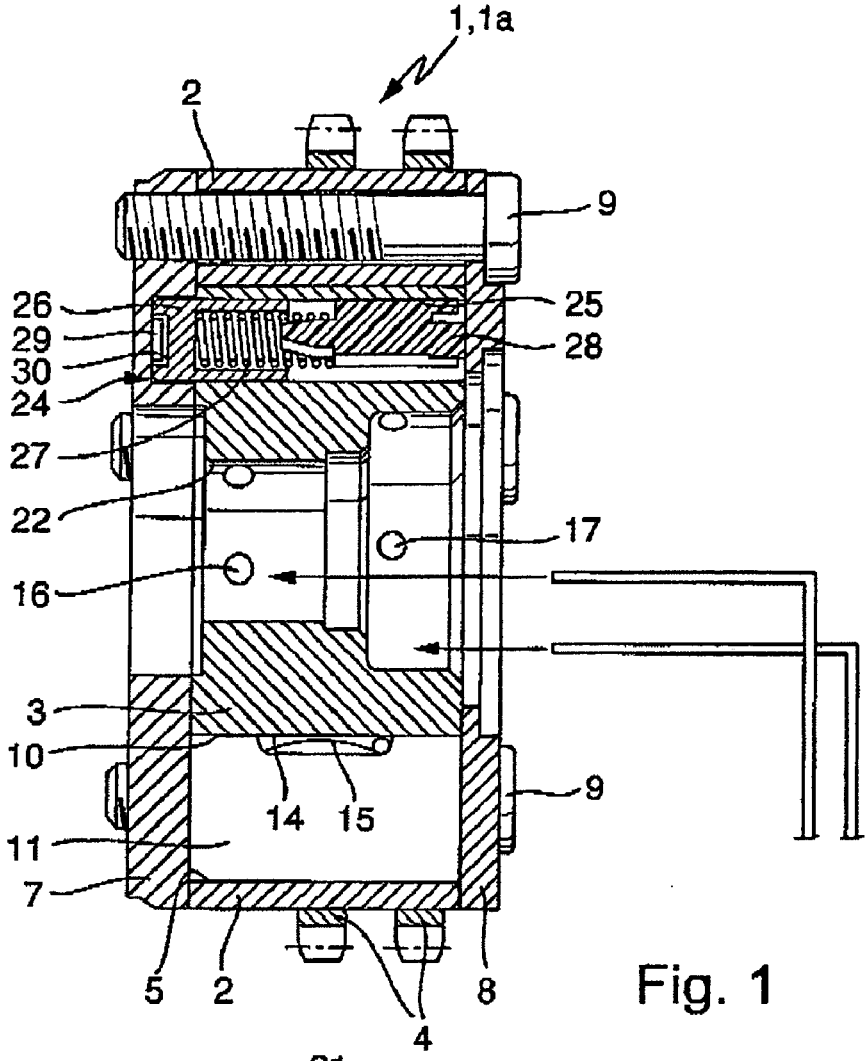
FIG. 1 shows a longitudinal section through a hydraulic actuation device.
Figure 2:
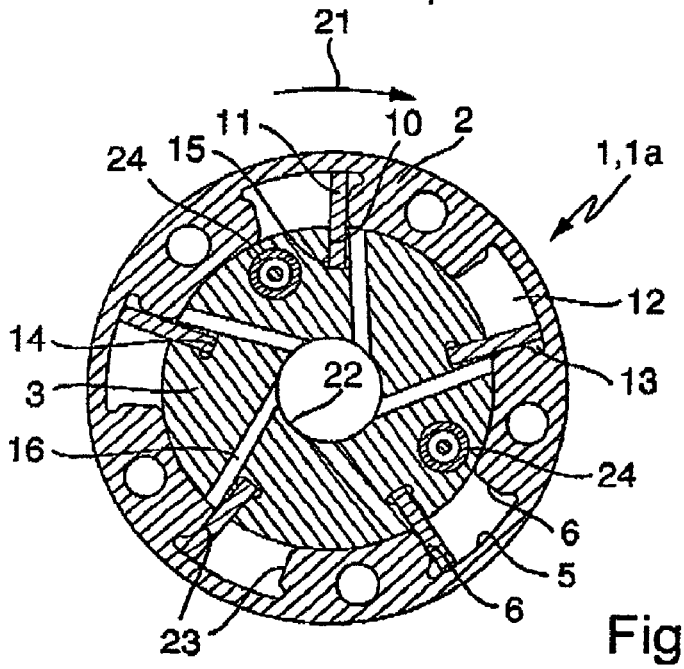
FIG. 2 shows a cross section through a hydraulic actuation device according to FIG. 1.

FIGS. 1 and 2 show a hydraulic adjustment device 1*a* of a device 1 for varying the control times of gas exchange valves in an internal combustion engine. The adjustment device 1*a* consists essentially of a stator 2 and of a rotor 3 arranged concentrically with respect to the latter. A driving wheel 4 is connected fixedly in terms of rotation to the stator 2 and, in the embodiment illustrated, is designed as a chainwheel. The embodiments of the driving wheel 4 as a beltwheel or gearwheel may likewise be envisaged. The stator 2 is mounted rotatably on the rotor 3, five recesses 5 spaced apart in the circumferential direction being provided on the inner surface area of the stator 2 in the embodiment illustrated. The recesses 5 are delimited in the radial direction by the stator 2 and the rotor 3, in the circumferential direction by two side walls 6 of the stator 2 and in the axial direction by a first and a second side cover 7, 8. Each of the recesses 5 is thereby closed in a pressure-tight manner. The first and the second side cover 7, 8 are connected to the stator 2 by means of connection elements 9, for example screws.

Axially running vane slots 10 are formed on the outer surface area of the rotor 3, a radially extending vane 11 being arranged in each vane slot 10. A vane 11 extends into each recess 5, the vanes 11 bearing in the radial direction against the stator 2 and in the axial direction against the side covers 7, 8. Each vane 11 subdivides a recess 5 into two reciprocally operating pressure chambers 12, 13. In order to ensure that the vanes 11 bear against the stator 2 in a pressure-tight manner, leaf-spring elements 15 are mounted between the slot bottoms 14 of the vane slots 10 and the vanes 11 and act with a force upon the vane 11 in the radial direction.

By means of first and second pressure-medium lines 16, 17, the first and second pressure chambers 12, 13 can be connected via a control valve, not illustrated, to a pressure-medium pump, likewise not illustrated, or to a tank, likewise not illustrated. An actuating drive is thereby formed, which allows a relative rotation of the stator 2 with respect to the rotor 3. In this case, there is provision either for all the first pressure chambers 12 to be connected to the pressure-medium pump and all the second pressure chambers 13 to be connected to the tank or for having the exactly opposite configuration. If the first pressure chambers 12 are connected to the pressure-medium pump and the second pressure chambers 13 are connected to the tank, the first pressure chambers 12 expand at the expense of the second pressure chambers 13. This results in a displacement of the vanes 11 in the circumferential direction, in the direction illustrated by the first arrow 21. As a result of the displacement of the vanes 11, the rotor 3 is rotated in relation to the stator 2.

In the embodiment illustrated, the stator 2 is driven by the crankshaft by means of a chain drive, not illustrated, which acts on the driving wheel 4 of the said stator. It is likewise conceivable for the stator 2 to be driven by means of a belt drive or gearwheel drive. The rotor 3 is connected to a camshaft, not illustrated, non-positively, positively or in a materially integral manner, for example by means of a press fit or by a screw connection by means of a central screw. The relative rotation of the rotor 3 in relation to the stator 2 as a consequence of the supply or discharge of pressure medium to or from the pressure chambers 12, 13 results in a phase shift between camshaft and crankshaft. Thus, owing to the controlled introduction or discharge of pressure medium into or out of the pressure chambers 12, 13, the control times of the gas exchange valves of the internal combustion engine can be varied in a controlled way.

In the embodiment illustrated, the pressure-medium lines 16, 17 are designed as essentially radially arranged bores which extend from a central bore 22 of the rotor 3 towards the outer surface area of the latter. Within the central bore 22, a central valve, not illustrated, may be arranged, via which the pressure chambers 12, 13 can be connected to the pressure-medium pump or to the tank in a controlled way. A further possibility lies in arranging within the central bore 22 a pressure-medium distributor which connects the pressure-medium lines 16, 17 to the connections of an externally mounted control valve via pressure-medium ducts and annular grooves.

The essentially radially running side walls 6 of the recesses 5 are provided with shaped-out portions 23 which extend into the recesses 5 in the circumferential direction. The shaped-out portions 23 serve as a stop for the vanes 11 and ensure that the pressure chambers 12, 13 can be supplied with pressure medium even when the rotor 3 assumes one of its two end positions in relation to the stator 2 in which the vanes 11 bear against one of the side walls 6.

If there is an insufficient supply of pressure medium to the device 1, for example during the starting phase of the internal combustion engine, the rotor 3 is moved in an uncontrolled way in relation to the stator 2 on account of the alternating and drag torques which the camshaft exerts on the said rotor. In a first phase, the drag torques of the camshaft urge the rotor in relation to the stator into a circumferential direction which lies opposite to the direction of rotation of the stator, until these butt against the side walls 6. The alternating torques which the camshaft exerts on the rotor 3 subsequently lead to a to-and-fro oscillation of the rotor 3 and consequently of the vanes 11 in the recesses 5, until at least one of the pressure chambers 12, 13 is filled completely with pressure medium. This leads to higher wear and to the generation of noise in the device 1. In order to prevent this, two locking elements 24 are provided in the device 1. Each locking element 24 consists of a pot-shaped piston 26 which is arranged in an axial bore 25 of the rotor 3. The piston 26 is acted upon with a force in the axial direction by a spring 27. The spring 27 is supported in the axial direction, on one side, on a venting element 28 and is arranged, with its axial end facing away from this, within the piston 26 of pot-shaped design.

A slide piece 29 is formed in the first side cover 7 for each locking element 24 in such a way that the rotor 3 can be locked in relation to the stator 2 in a position which corresponds to the position during the starting of the internal combustion engine. In this position, if there is an insufficient supply of pressure medium to the device 1, the pistons 26 are urged into the slide pieces 29 by means of the springs 27. Furthermore, means are provided in order, when there is a sufficient supply of pressure medium to the device 1, to urge the pistons 26 back into the axial bores 25 and consequently to cancel the lock. This is brought about conventionally by means of pressure medium which is conducted via pressure-medium lines, not illustrated, into a clearance 30 which is formed on the cover-side end face of the pistons 26. If the phase position $\phi$ which corresponds to the starting position of the internal combustion engine corresponds to a mid-position of the vanes 11 between the respective side walls 6, then a locking of the hydraulic actuation device 1*a* in this position can be brought about, using two locking elements 24 and adapted slide pieces 29.

So that leakage oil can be discharged from the spring space of the axial bore 25, the venting element 28 is provided with axially running grooves, along which the pressure medium can be conducted to a bore in the second side cover 8.

Figure 8:
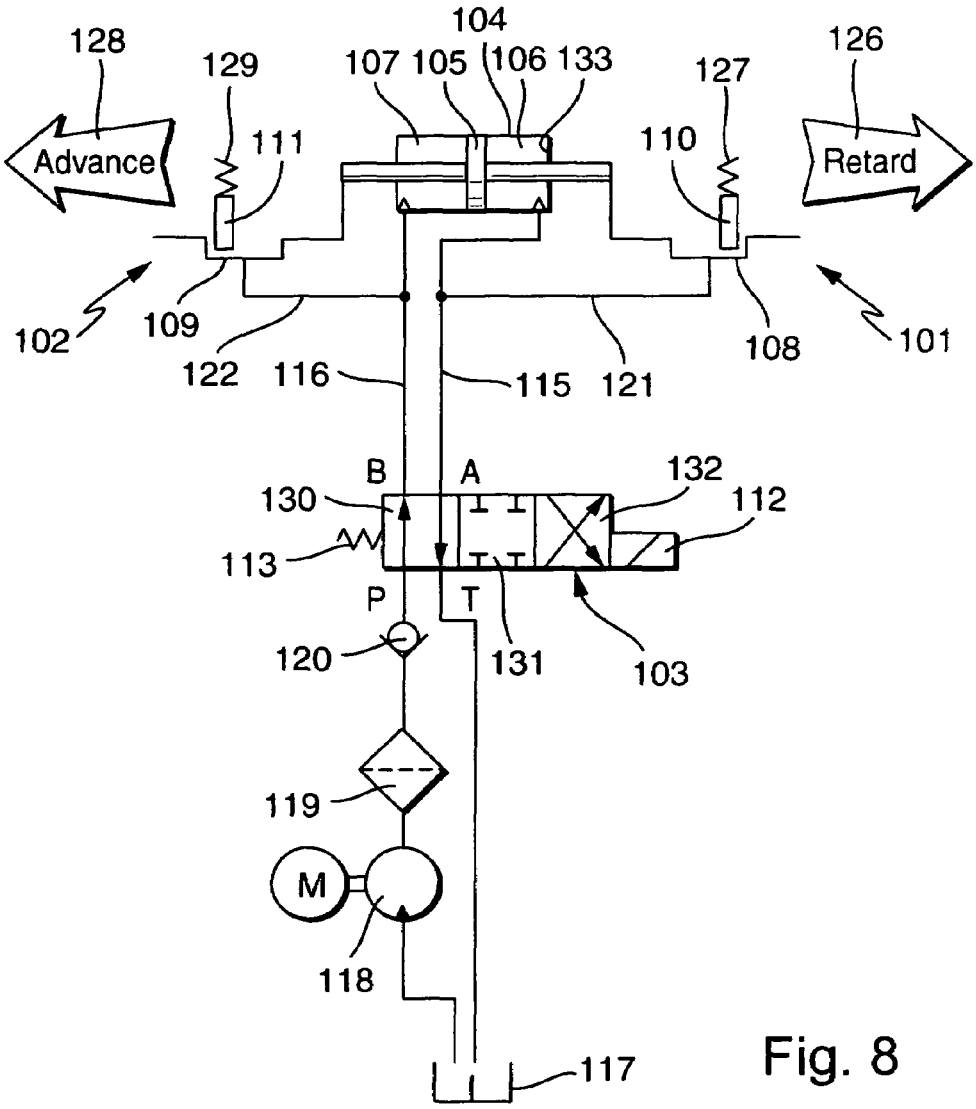
Fig. 8 PRIOR ART
FIG. 8 shows a diagrammatic illustration of a device for varying the control times of gas exchange valves of an internal combustion engine from the prior art.

FIG. 8 shows a device 101 for varying the control times of gas exchange valves of an internal combustion engine from the prior art. This consists of a hydraulic actuation device 102 and of a control valve 103.

The actuation device 102 consists of a pressure space 104 which is subdivided into two reciprocally acting pressure chambers 106, 107 by means of a displaceable element 105. The displaceable element 105 is connected fixedly in terms of rotation to the camshaft or the crankshaft, whilst the other component is connected fixedly in terms of rotation to the pressure space 104. The displaceable element 105 is connected fixedly in terms of movement to two slide pieces 108, 109. Furthermore, a locking pin is designated in each case by 110 and 111, these being mounted fixedly with respect to the pressure space 104. Each slide piece 108, 109 is assigned in each case a locking pin 110, 111. Alternatively, the locking pins 110, 111 may be co-moved with the element 105 and the slide pieces 108, 109 may be formed in a component which is fixed with respect to the pressure space 104.

The control valve 103 consists of an actuation unit 112, of a first spring element 113 and of a valve body 114. The actuation unit 112 may be designed, for example, in the form of an electrical or hydraulic actuation unit 112. An electrical actuation unit 112 which is designed as an electromagnet is to be assumed hereafter, without any restriction of generality. A first working connection A, a second working connection B, an inflow connection P and an outflow connection T are formed on the valve body 114. The first working connection A is connected to the first pressure chamber 106 via a first pressure-medium line 115 and the second working connection B is connected to the second pressure chamber 107 via a second pressure-medium line 116. Furthermore, the outflow connection T is connected to a pressure-medium reservoir 117. The inflow connection P is acted upon by a pressure medium via a pressure-medium pump 118, a filter 119 and a non-return valve 120. The first slide piece 108 is connected to the first pressure-medium line 115 via a third pressure-medium line 121. The second slide piece 109 is likewise connected to the second pressure-medium line 116 via a fourth pressure-medium line 122. The first the second slide piece 108, 109 are in each case designed as a slot, their dimension in the direction of movement of the movable element 105 being greater than that of the respective locking pin 110, 111. In the illustrated mid-position of the displaceable element 105, both locking pins 110, 111 engage into the respective slide pieces 108, 109 and are arranged at one end of the respective slot in the direction of displacement of the movable element 105.

By means of the actuation unit 112, the valve can be brought into a second, a third and a fourth control position 130, 131, 132 counter to the spring force of the first spring element 113. When the valve is in the second control position 130, which is the case when there is a low to no application of current to the actuation unit 112, the second working connection B is connected solely to the inflow connection P and the first working connection A solely to the outflow connection T.

When the valve is in the third control position 131, which is the case when there is a low to medium application of current to the actuation unit 112, the two working connections A, B are not connected either to the inflow connection P or to the outflow connection T. Alternatively, there may be provision for the two working connections A, B to be connected solely to the inflow connection P, in order to compensate leakage losses.

When the valve is in the fourth control position 132, which is the case when there is a medium to maximum application of current to the actuation unit 112, the first working connection A is connectedly solely to the inflow connection P and the second working connection B solely to the outflow connection T.

In the regulated operation of the internal combustion engine, the control valve 103 is brought into the second control position 130, in order to achieve an adjustment of the movable element 105 to retarded, identified by the second arrow 126. Pressure medium is conducted from the inflow connection P to the second pressure chamber 107 via the second working connection B and the second pressure-medium line 116. At the same time, pressure medium is conducted into the second slide piece 109 via the fourth pressure-medium line 122. The second locking pin 111 is thereby urged out of the second slide piece 109 counter to the force of a second spring 129. At the same time, the first pressure chamber 106 is connected to the pressure-medium reservoir 117 via the first pressure-medium line 115 and the outflow connection T. Owing to the outflow of pressure medium from the first pressure chamber 106 and the inflow of pressure medium to the second pressure chamber 107, the movable element 105 is displaced to retarded. At the same time, the first and the second slide piece 108, 109 are likewise displaced to retarded. In this case, the first locking pin 110 moves within the first slide piece 108, whilst the second locking pin 111 is located outside the second slide piece 109.

In order to hold a phase position $\phi$ of the hydraulic actuation device 102, the control valve 103 is brought into the third control position 131. The two working connections A, B are not connected either to the inflow connection P or to the outflow connection T. There is no inflow or outflow of pressure medium to or from the pressure chambers 106, 107, and the phase position $\phi$ is held constant.

In order to achieve an adjustment of the movable element 105 to advanced, identified by the third arrow 128, the control valve 103 is brought into the fourth control position 132. Pressure medium is conducted from the inflow connection P to the first pressure chamber 106 via the first working connection A and the first pressure-medium line 115. At the same time, pressure medium is conducted into the first slide piece 108 via the third pressure-medium line 121. The first locking pin 110 is thereby urged out of the first slide piece 108 counter to the force of a first spring 127. At the same time, the second pressure chamber 107 is connected to the pressure-medium reservoir 117 via the second pressure-medium line 116 and the outflow connection T. Owing to the outflow of pressure medium from the second pressure chamber 107 and the inflow of pressure medium to the first pressure chamber 106, the movable element 105 is displaced to advanced. At the same time, the first and the second slide pieces 108, 109 are likewise displaced to advanced. In this case, the second locking pin 111 is moved within the second slide piece 109, whilst the first locking pin 110 is located outside the first slide piece 108.

When the movable element 105 is adjusted, from a position which deviates from the mid-position illustrated in FIG. 8, beyond the mid-position, the locking pin 110, 111 which is not acted upon by pressure medium engages into the respective slide piece 108, 109. At the same time, the other locking pin 110, 111 is acted upon by pressure medium in such a way that it is located outside the slide piece 108, 109. Movement is restricted solely by the engaged locking pin 110, 111.

When the hydraulic actuation device 102 is in the middle position illustrated in FIG. 8 and the device 101 is not supplied with sufficient pressure medium, this being the case, for example, during the starting of the internal combustion engine, then the two locking pins 110, 111 are engaged in the respective slide pieces 108, 109. In this case, the locking pins 110, 111 are arranged in such a way and the slide pieces 108, 109 designed in such a way that the locking pins 110, 111 are located at those ends of the slide pieces 108, 109 which are spaced furthest apart from one another. The movable element 105 is thereby fixed in relation to the pressure space 104. Alternatively, the locking pins 110, 111 may be located at those ends of the slide pieces 108, 109 which are nearest to one another. In this alternative embodiment, the first slide piece 108 would have to be acted upon with pressure medium by the second pressure-medium line 116 and the second slide piece 109 by the first pressure-medium line 115. It is likewise conceivable for the slide pieces 108, 109 to be acted upon via the respective pressure chamber 106, 107, for example by means of a worm groove.

During the stopping operation of the internal combustion engine, there is the possibility that the displaceable element 105 is positioned in a retarded position with respect to the mid-position. When the internal combustion engine is restarted, the device 101 is not yet sufficiently filled with pressure medium. On account of the drag torque of the camshaft, the element 105 is driven in the direction of the retard stop 133 and butts there. This leads to an increased wear of the components and to the generation of unpleasant noise.

If the actuation unit 112 of the control valve 103 fails, for example if the current supply is interrupted due to a defect of the electromagnet or of the current connections, then the control valve 103 is shifted into the second control position 130. The result of this is that the second locking pin 111 is unlocked and the camshaft is retarded in relation to the crankshaft. The consequence of this is that the starting and running properties of the internal combustion engine, which are optimum in the mid-position illustrated in FIG. 8, are impaired.

The hydraulic actuation device 102 illustrated diagrammatically may be, for example, an axial-piston adjuster or a rotary-piston adjuster. Only the embodiment of a rotory-piston adjuster is to be dealt with below, without any restriction of generality. The pressure space 104 corresponds to the recesses 5 from FIG. 1. The movable element 105 corresponds to the vanes 11. In the embodiment according to FIG. 1, the locking pins 110, 111 may be arranged either in a side cover of the rotary-piston adjuster or in the rotor of the rotary-piston adjuster within a bore, preferably a blind hole. The respective slide pieces 108, 109 are formed in the other component in each case.

Figure 4:
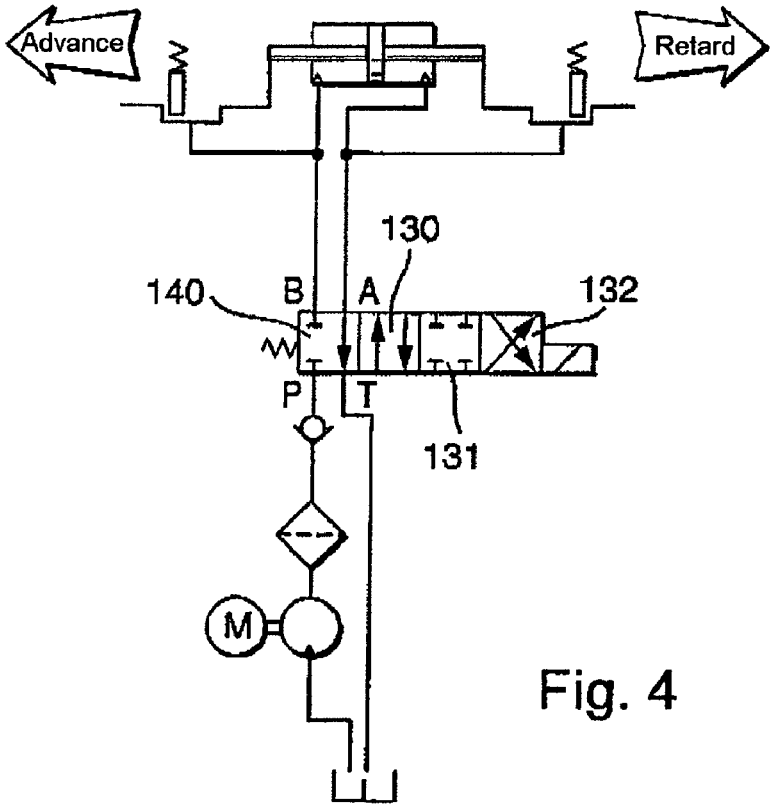
FIG. 4 shows a diagrammatic illustration of a device according to the invention for varying the control times of gas exchange valves of an internal combustion engine.

FIG. 4 illustrates a device 101 according to the invention diagrammatically, in a similar way to FIG. 8. This is for the most part identical to that shown in FIG. 8, and therefore the same reference numerals have been used for identical components. The difference in the device 101 according to the invention is that the control valve 103 additionally has a first control position 140. The first control position 140 is activated when the actuation unit 112 assumes a state which corresponds to low to no application of current. In this case, the first spring element 113 ensures that the first control position 140 is reached. In this position, neither the first nor the second working connection A, B is connected to the inflow connection P. Depending on the configuration of the hydraulic actuation device 102, then, either the first or the second working connection A, B can be connected to the outflow connection T, whilst the other working connection A, B in each case does not communicate with the outflow connection T. An embodiment may likewise be envisaged in which, in the first control position 140, the first and the second working connection A, B do not communicate either with the inflow connection P or with the outflow connection T or both working connections A, B are connected solely to the outflow connection T. In addition to the first control position 140, the control valve 103 likewise has the second, third and fourth control positions 103, 131, 132 illustrated in FIG. 8, the second control position 130 being assumed in the case of a low to medium application of current, the third control position 131 in the case of a medium to high application of current and the fourth control position 132 in the case of a high to maximum application of current to the actuation unit 112.

In the event of a defect of the actuation unit 112 or of a fault in its current supply, the control valve 103 automatically assumes the first control position 140, the control valve 103 holding this position until the repair of the actuation unit 112 or its current supply. After a renewed starting of the internal combustion engine, on account of the insufficient supply of pressure medium to the hydraulic actuation device 102, the movable element 105 is moved into the middle position because of the drag or alternating torques, irrespective of its position at the stopping of the internal combustion engine. In this middle position, the two locking pins 110, 111 can engage into the respective slide piece 108, 109, with the result that the position of the movable element 105 in the pressure space 104 is fixed. Owing to the configuration of the first control position 140, during the operation of the internal combustion engine no pressure medium is routed to the pressure chambers 106, 107 and therefore to the slide pieces 108, 109. The consequence of this is that the movable element 105 is held fixedly in relation to the pressure space 104, and consequently the phase position $\phi$ between camshaft and crankshaft is held constant in the emergency running position, in which the internal combustion engine has good starting and running properties.

FIGS. 5*a* to 5*d* show by way of example a valve body 114 of a control valve 103 of a device 101 according to the invention. The valve body 114 consists of a valve housing 141 and of a control piston 142. The valve housing 141 is of essentially hollow-cylindrical design, three annular grooves 143, 144, 145 spaced apart axially being formed in its outer surface area. Each of the annular grooves 143 to 145 constitutes a connection of the valve, the axially outer annular grooves 143, 145 forming the working connections A, B, and the middle annular groove 144 forming the inflow connection P. An outflow connection T is formed by a port in one end face of the valve housing 141. Each of the annular grooves 143 to 145 is connected to the inside of the valve housing 141 via first radial ports 146. A control piston 142 of essentially hollow-cylindrical design is arranged axially displacably within the valve housing 141. The control piston 142 is acted upon with a force on one end face by a second spring element 147 and on the opposite end face by a tappet push rod 148 of the actuation unit 112. By current being applied to the actuation unit 112, the control piston 142 can be displaced, counter to the force of the second spring element 147, into any desired position between a first and a second limit stop 149, 150.

The control piston 142 is provided with a first and a second annular web 151, 152. The outside diameters of the annular webs 151, 152 are adapted to the inside diameter of the valve housing 141. Furthermore, second radial ports 146*a* are formed in the control piston 142 between its end face on which the tappet push rod 148 engages and the second annular web 152, with the result that the interior of the control piston 142 is connected to the inside of the valve housing 141. The first and the second annular web 151, 152 are designed and arranged on the outer surface area of the control piston 142 in such a way that, as a function of the position of the control piston 142 in relation to the valve housing 141, control edges 153 to 156 release or shut off a connection between the inflow connection P and the working connections A, B and release or shut off a connection between the working connections A, B and the outflow connection T. The outside diameter of the control piston 142 is designed to be smaller than the inside diameter of the valve housing 141 in the regions between the tappet push rod 148 and the second annular web 152 and between the first annular web 151 and the second annular web 152. A fourth annular groove 157 is thereby formed between the first and the second annular web 151, 152. A third annular web 158 is formed within the fourth annular groove 157. The outside diameter of the third annular web 158 is adapted to the inside diameter of the valve housing 141. Furthermore, the third annular web 158 is positioned in such a way that it shuts off the connection between the inflow connection P and the second working connection B in the first control position 140 of the control valve 103.

Figure 5A:
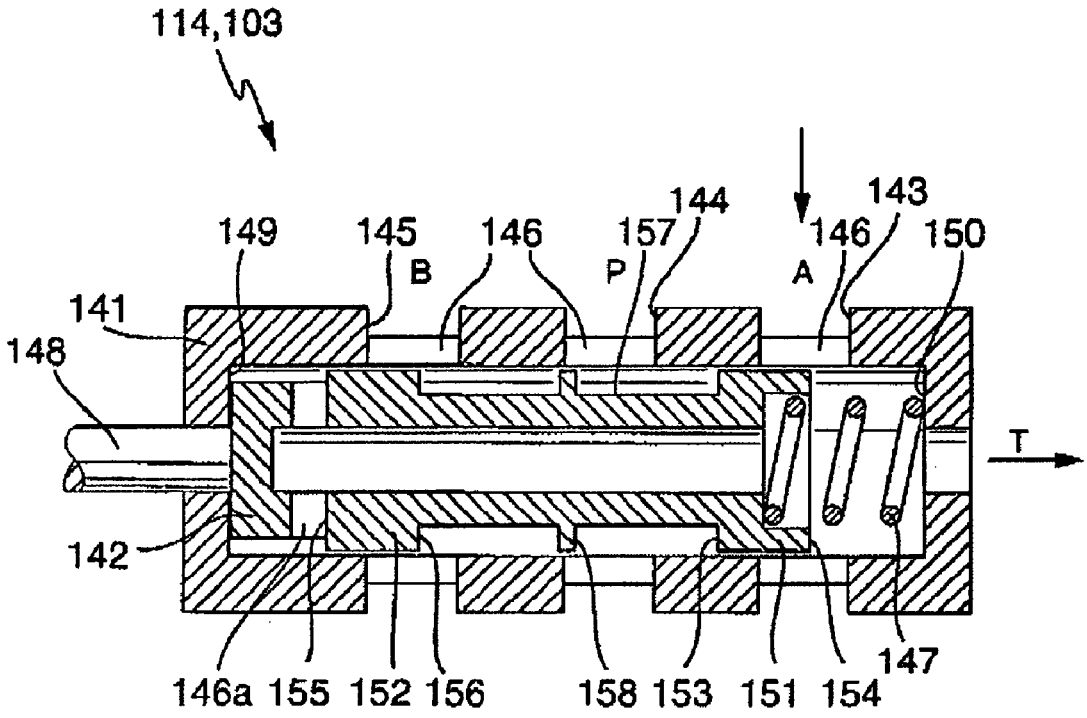
FIG. 5*a* shows a longitudinal section through a control valve of a device according to the invention for varying the control times of gas exchange valves of an internal combustion engine, in a first control position.

FIG. 5*a* shows the first control position 140 of the control valve 103, in which the control piston 142 is acted upon with a force between a minimum force and a low force $F_1$ by the actuation unit 112 via the tappet push rod 148. That end face of the control piston 142 which is on the tappet push rod side is located in a region between the first limit stop 149 (displacement travel=0 mm) and a displacement travel $s_1$. The connection between the inflow connection P and the second working connection B is shut off by the third annular web 158 and the connection between the inflow connection P and the first working connection A is shut off by the first annular web 151. Furthermore, the connection between the second working connection B and the outflow connection T is shut off by means of the second annular web 152, whereas pressure medium can flow from the first working connection A to the outflow connection T. Since the pressure-medium flow to both locking pins 110, 111 and to both pressure chambers 106, 107 is blocked, no active adjustment can take place in the first control position 140. Owing to the connection of the first pressure chamber 106 to the reservoir 11, the latter is emptied. As a function of the position of the hydraulic actuation device 102, the movable element 105 is immediately, or after a certain time required to empty the second pressure chamber 107 due to leakage, driven into the mid-position, and permanently locked there, because of drag or alternating torques of the camshaft.

This control position corresponds to a configuration of the control valve 103 in which there is no application of current to the actuation unit 112, and consequently the control piston 142 is displaced onto the first limit stop 149 by means of the second spring element 147, that is to say the displacement travel is zero. The valve is in this position when the actuation unit 112 is defective or the current supply of the latter is interrupted.

Figure 5B:
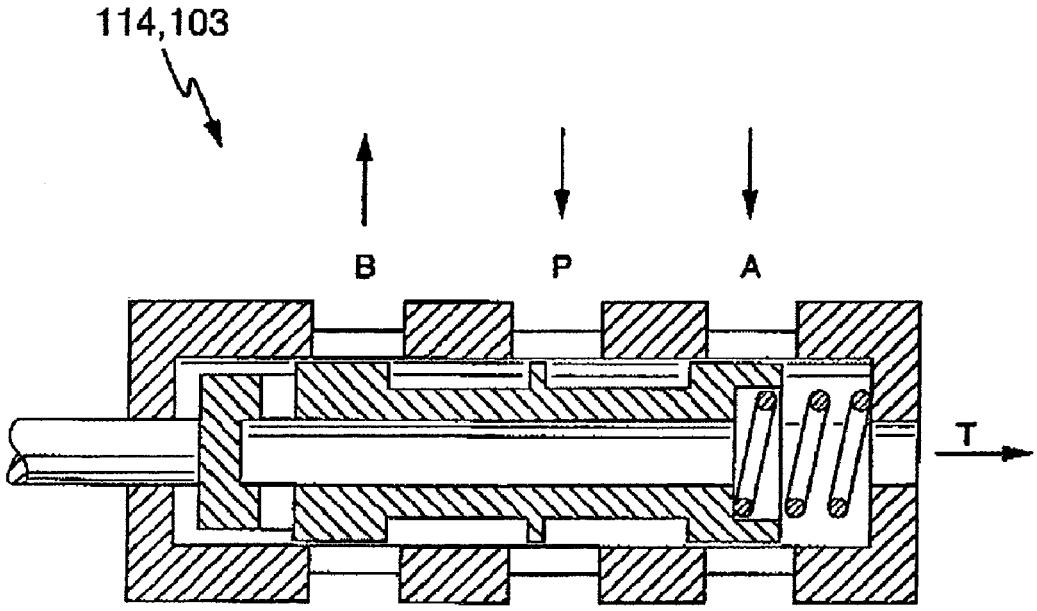
FIG. 5*b* shows a longitudinal section through the control valve from FIG. 5*a*, in a second control position.

FIG. 5*b* shows the second control position 130 of the control valve 103, in which the control piston 142 is acted upon with a force between a low force $F_1$ and a medium force $F_2$ by the actuation unit 112 via the tappet push rod 148, in which case $F_2>F_1$. As a result, the control piston 142 is displaced by the amount of a travel $S_1$ to $S_2$ from the first limit stop 149 located on the tappet push rod side, in which case $S_2>S_1$. Furthermore, the first annular web 151 blocks the connection between the first working connection A and the inflow connection P, whereas pressure medium can continue to flow from the first working connection to the outflow connection T. Furthermore, the second annular web 152 blocks the connection between the second working connection B and the outflow connection T, whereas both the second and the third annular web 152, 158 release a connection between the inflow connection P and the second working connection B. In this position, pressure medium is supplied via the second working connection B to the second and the fourth pressure-medium line 116, 122 of the second pressure chamber 107 and to the second slide piece 109, with the result that the second locking pin 111 is unlocked and retards the hydraulic actuation device 102. At the same time, pressure medium flows out of the first pressure chamber 106 via the first pressure-medium line 115 to the first working connection A and from there to the outflow connection T.

Figure 5C:
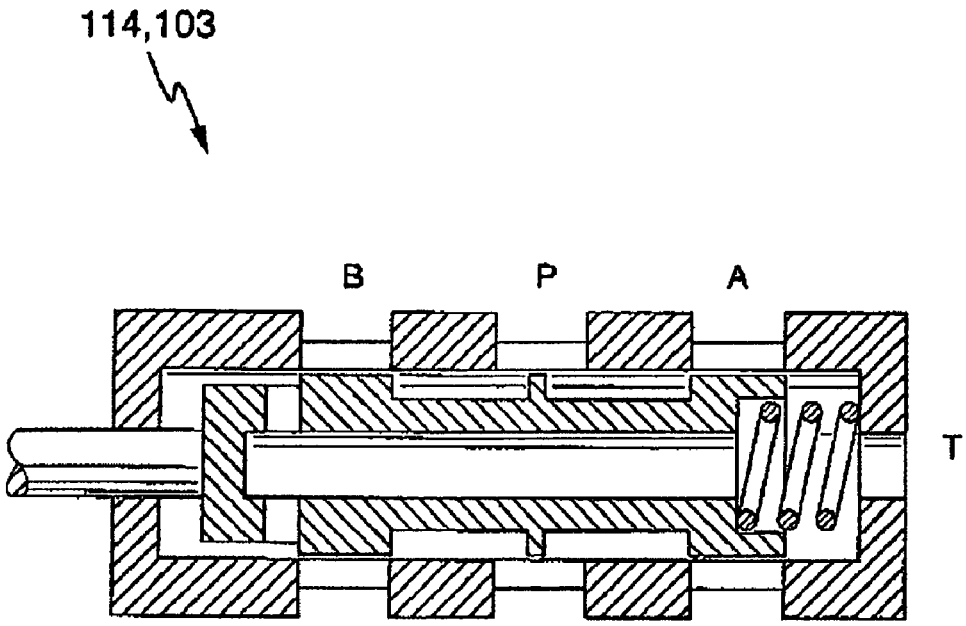
FIG. 5*c* shows a longitudinal section through the control valve from FIG. 5*a*, in a third control position.

FIG. 5*c* shows the third control position 131 of the control valve 103, in which the control piston 142 is acted upon with a force between a medium force $F_2$ and a high force $F_3$ by the actuation unit 112 via the tappet push rod 148, in which case $F_3>F_2$. As a result, the control piston 142 is displaced by the amount of a travel $S_2$ to $S_3$ from the first limit stop 149 located on the tappet push rod side, in which case $S_3>S_2$. In this position of the control valve, the first and the second annular web 151, 152 block the connections between the working connections A, B and the inflow connection P and the connections between the working connections A, B and the outflow connection T. In this position of the control valve 103, neither pressure medium is delivered to the pressure chambers 106, 107 nor pressure medium can flow out from the pressure chambers 106, 107. This control position therefore corresponds to a holding position, in which the phase position $\phi$ between camshaft and crankshaft is held constant.

Figure 5D:
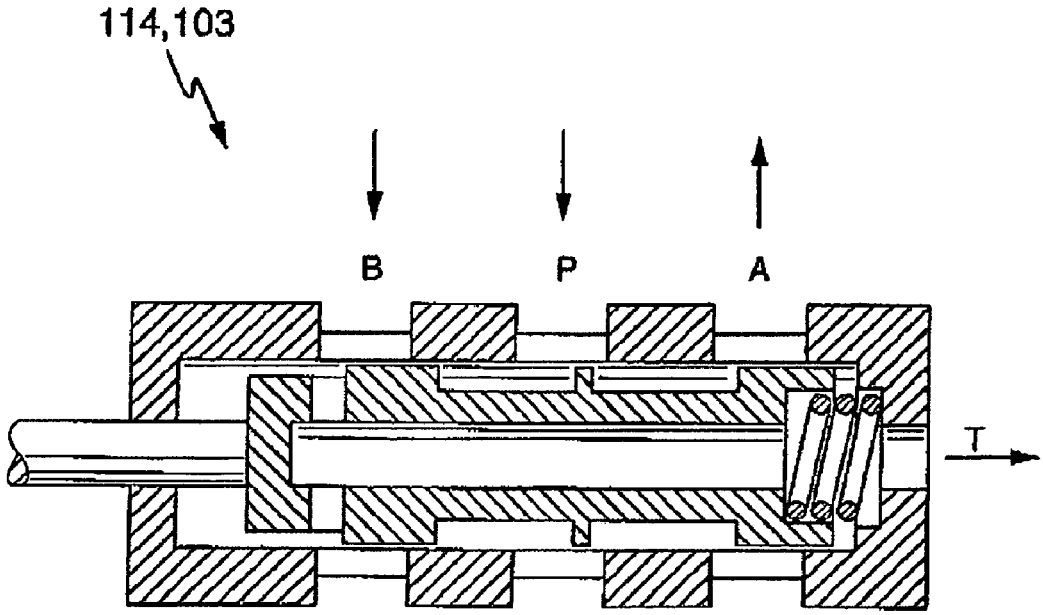
FIG. 5*d* shows a longitudinal section through the control valve from FIG. 5*a*, in a fourth control position.

FIG. 5*d* shows the fourth control position 132 of the control valve 103, in which the control piston 142 is acted upon with a force between a high force $F_3$ and a maximum force $F_4$ by the actuation unit 112 via the tappet push rod 148, in which case $F_4>F_3$. As a result, the control piston 142 is displaced by the amount of a travel $S_3$ to $S_4$ from the first limit stop 149 located on the tappet push rod side, in which case $S_4>S_3$. In this configuration, the first annular web 151 blocks a connection between the first working connection A and the outflow connection T, whilst the connection between the inflow connection P and the first working connection A is released both by the first annular web 151 and by the third annular web 158. Furthermore, the connection between the inflow connection P and the second working connection B is blocked by the second annular web 152, whilst pressure medium can pass via the second working connection B and the second radial ports 146*a* into the interior of the control piston 142 and from there to the outflow connection T. In this position of the control valve 103, pressure medium is conducted from the second pressure chamber 107 via the second pressure-medium line 116 to the second working connection B and from there to the outflow connection T. At the same time, pressure medium is conducted to the first pressure chamber 106 and to the first slide piece 108 via the first working connection A, the first pressure-medium line 115 and the third pressure-medium line 121. The first locking pin 110 is thereby unlocked and the hydraulic actuation device 102 is advanced.

By the 4/4-way valve described being used as a control valve 103 of the device 101 according to the invention, no additional modules, such as, for example, additional control valves, are required in order to produce a device 101 with mid-position locking, which starts automatically in a locked mid-position, a butting of the element 105 (vane in the case of vane-cell adjusters) against a stop being absent. Neither the construction space nor the production or assembly costs are increased, as compared with the embodiment described in the prior art. At the same time, in the event of the failure of the actuation unit 112, the device 101 is brought into the mid-position and is locked there until the actuation unit 112 is repaired.

Figure 6:
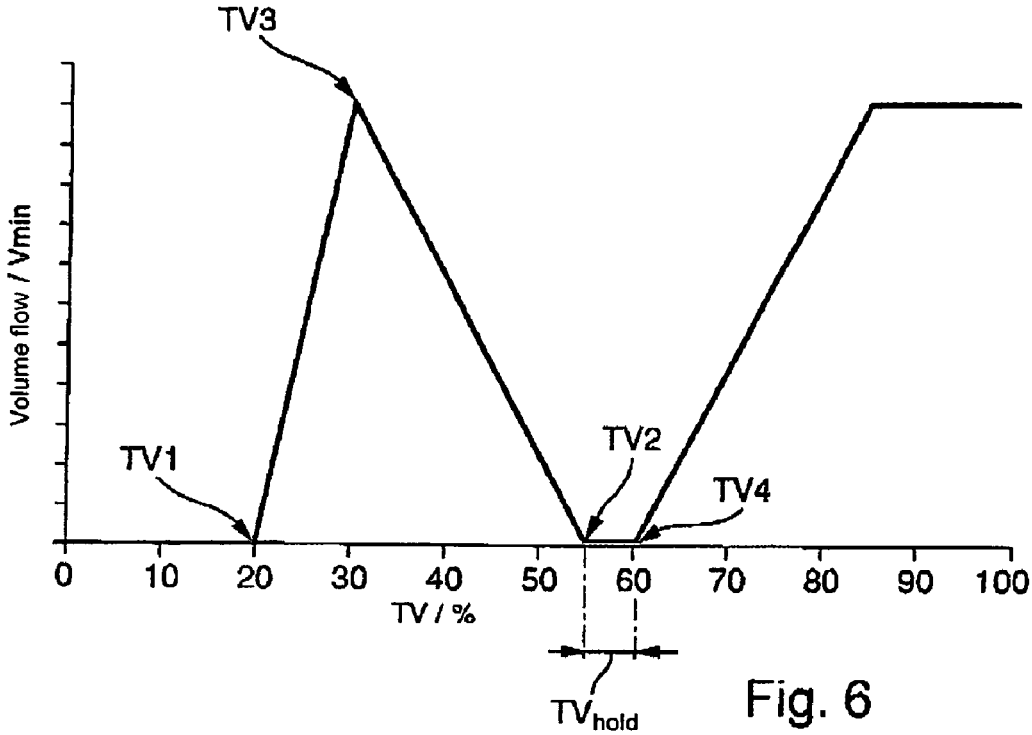
FIG. 6 shows a graph of the volume flow from the inflow connection to the pressure chambers as a function of the position of the control piston in relation to the valve housing.

FIG. 6 illustrates the volume flow from the inflow connection T to the pressure chambers 106, 107 as a function of the duty factor of the actuation unit 112. The actuation unit 112 can be acted upon with a voltage, either zero volts or a maximum value occurring. The duty factor indicates the fraction of time in which the maximum value of the voltage occurs at the actuation unit 112. The higher the duty factor is, the higher is the force which is exerted on the control piston 142 by the actuation unit 112 via the tappet push rod 148. The duty factor is therefore a measure of the displacement of the control piston 142 within the valve housing 141 in relation to the first limit stop 149.

In a first range in which the duty factor lies between zero and a first value TV1, the control valve 103 assumes the first control position 140. In this control position 140, the connections between the inflow connection P and the working connections A, B are shut off and the volume flow is 0 apart from leakage flows. When the duty factor lies between a first value TV1 and a second value TV2, the control valve 103 is in the second control position 130. Pressure medium can pass from the inflow connection P to the second working connection B, whilst the connection between the inflow connection P and the first working connection A is shut off. The volume flow increases continuously with a rise in the duty factor from a first value TV1 to a third value TV3, whereas it decreases continuously during a further rise to the second value TV3, and finally, at the value TV2, is near zero. Advantageously, only the range between TV3 and TV2 is used for the second control position 130.

In a third range between the value TV2 and a value TV4, duty factors lying in this range are designated below as a holding duty factor, the volume flow of the duty factor is virtually zero. This range corresponds to the third control position 131 of the control valve 103 in which neither of the two working connections A, B is connected to the inflow connection P.

When the value of the duty factor rises further to 100%, starting from the value TV4, the volume flow from the inflow connection P to the pressure chamber 106, 107 first increases continuously. The volume flow may rise continuously to a duty factor of 100% or else, as a consequence of construction, may pass through a maximum. This range corresponds to the fourth control position 132 of the control valve 103 in which pressure medium is conducted from the inflow connection P to the first working connection A, whilst the connection between the inflow connection P and the second working connection B is blocked.

In addition to the advantage that, in the event of the failure of the actuation unit 112, and when the internal combustion engine is restarted, the hydraulic actuation device 102 is locked in a mid-position and this lock is maintained, the device 101 according to the invention makes it possible, with the actuation unit 112 intact, to lock the hydraulic actuation device 102 in the mid-position when the internal combustion engine is stopped, or to position the hydraulic actuation device 102 in such a way that, when the internal combustion engine is restarted, the hydraulic actuation device 102 is brought into the mid-position and locked there. The advantage of this is that, during the starting operation in which the device 101 is not yet sufficiently filled with pressure medium, the hydraulic actuation device 102 is reliably locked in the mid-position, with the result that a butting of the displaceable element 105 against a side wall of the pressure space 104 is avoided, thereby avoiding increased wear and the generation of noise.

To operate the internal combustion engine, the various duty factors, in particular TV1 to TV3, and the holding duty factor $TV_{hold}$ must be known to the engine control apparatus. The holding duty factor is determined as standard by the engine control apparatus and is filed in a memory unit. Two possibilities may be envisaged for determining TV1, TV2 and TV3.

TV1, TV2 and TV3 can be determined as a direct function of the holding duty factor $TV_{hold}$ via the design and the valve characteristic following from this. The difference angles $Y_1$, $Y_2$ and $Y_3$ are filed permanently in a memory unit. In an early phase of the operation of the internal combustion engine, the engine control apparatus determines the holding duty factor $TV_{hold}$. The following then applies to TV1, TV2 and TV3:

$$TV1=TV_{hold}-Y1,$$

$$TV2=TV_{hold}-Y2,$$

$$TV3=TV_{hold}-Y3.$$

A second method is to cause TV1 and TV2 to be determined by the engine control apparatus, if appropriate after each new start, and to file them in the characteristic diagram. To determine TV1 and TV3, the camshaft angle signals and crankshaft angle signals may be used. Above all, the relative phase position of the two shafts and the time change in the phase position can be utilized for this purpose. For example, the following method may be adopted. A ramp of the duty factor rising from 0% is run through. The value TV1 is reached when an adjustment operation starts (at this point, one of the pressure chambers 106, 107 and a locking pin 110, 111 are acted upon by pressure medium and the hydraulic actuation device is adjusted, which can be detected via camshaft angle sensors and crankshaft angle sensors). The value TV3 is reached when a maximum adjustment speed is overshot. TV2 is reached when the phase position is held constant. The values determined are subsequently filed in a memory.

Figure 7:
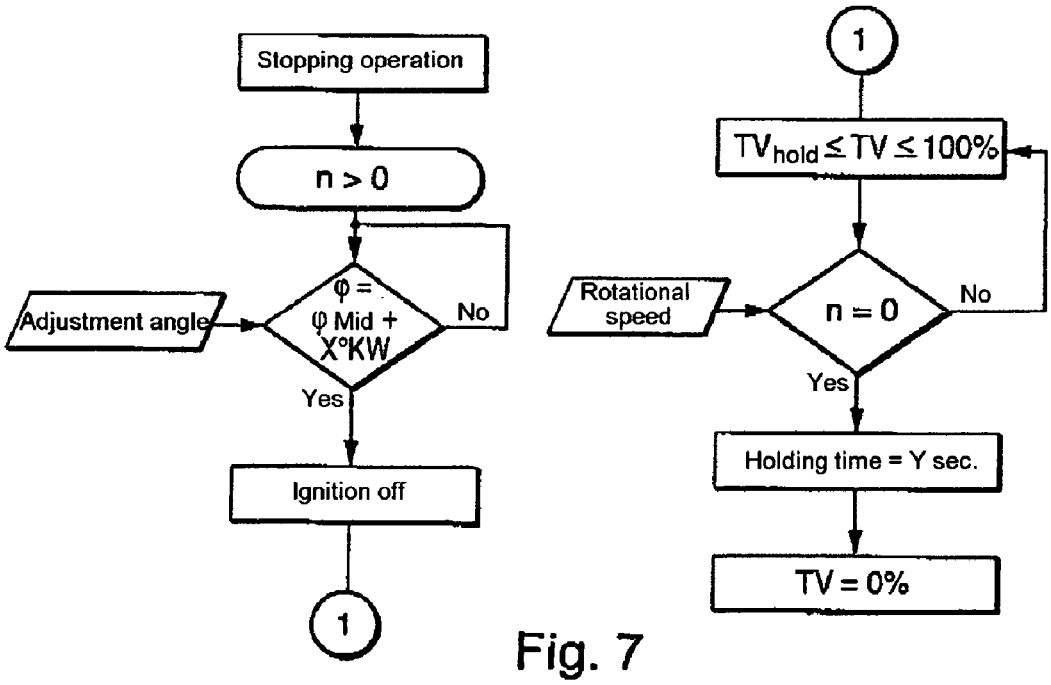
FIG. 7 shows a flowchart for a method for the regulated stopping of an internal combustion engine with a device according to the invention for varying the control times of gas exchange valves.

FIG. 7 shows a flowchart of a method for controlling the device 101 according to the invention during a stopping operation of the internal combustion engine, by means of which method the hydraulic actuation device 102 is brought into a position in which, after the stopping of the internal combustion engine, it is either locked or in a position from which, after the restarting of the internal combustion engine, it is displaced directly into the mid-position and locked there.

When the stopping operation of the internal combustion engine is initiated, the rotational speed is n>zero. The phase position $\phi$ between camshaft and crankshaft is brought with the aid of the control valve 103 into a stopping phase position which deviates by a defined amount X from the locking phase position $\phi_{mid}$. For a device 101 which is designed without a compensation spring, the stopping phase position is displaced to advanced in relation to the locking phase position $\phi_{mid}$. The same applies to a device 101 which is equipped with a compensation spring, of which the torque, however, is lower than the drag torque of the camshaft. For a device 101 with a compensation spring which exerts a torque higher than the drag torque of the camshaft, the stopping phase is displaced to retarded in relation to the locking phase position $\phi_{mid}$. When the predetermined stopping phase position is reached, the ignition is switched off and the value of the duty factor is set in such a way that this phase position $\phi$ is reliably held. In the event of a setting of an advanced stopping phase position, therefore, the duty factor lies between TV2 and 100%, and, in the case of a stopping phase position which is retarded in relation to the locking phase position $\phi_{mid}$, the duty factor is between TV4 and TV3. This duty factor is held until the rotational-speed sensors communicate the rotational speed zero. Thereafter, the set duty factor is held for a specific timespan Y before the actuation unit 112 is finally held currentless. The holding time of Y prevents the situation where, during the last revolution of the internal combustion engine during which the rotational-speed sensor already delivers the rotational speed n=0, the locking pins 110, 111 are unlocked on account of pressure fluctuations due to the alternating torques and the movable element 105 is pushed beyond the mid-position into the wrong position.

The hydraulic actuation device 102 is then either in the locked state owing to the last revolution of the crankshaft or in a position in which the said actuation device is driven automatically and immediately into the locked position either by the drag torques of the camshaft or by the torque of the compensation spring during the starting of the internal combustion engine.

Figure 3:
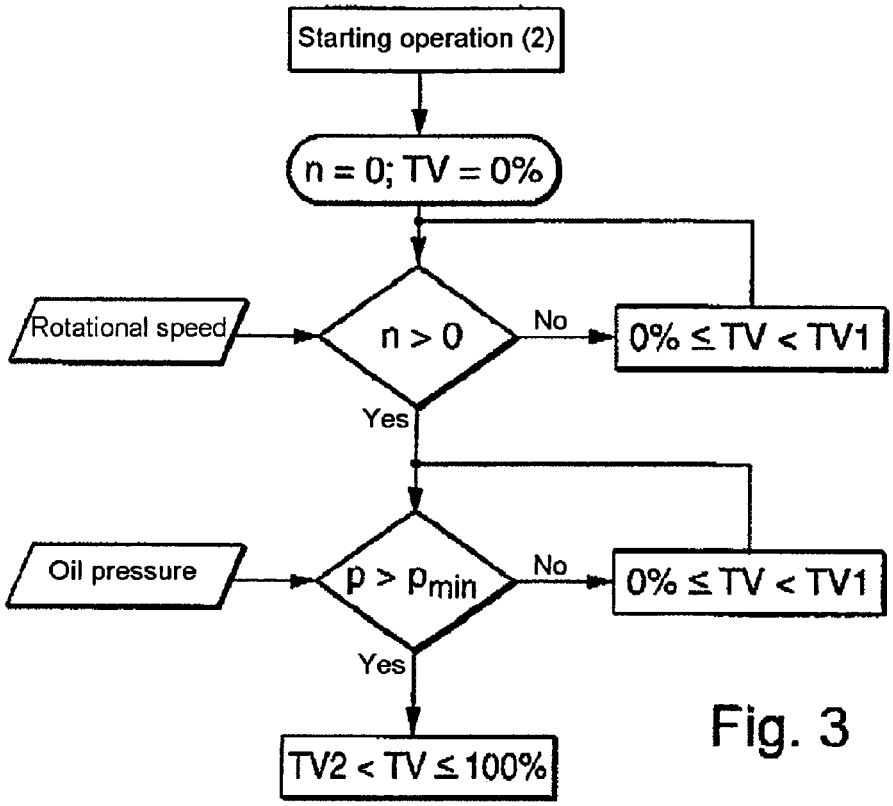
FIG. 3 shows a flowchart for a method for starting an internal combustion engine with a device according to the invention for varying the control times of gas exchange valves.

FIG. 3 shows a flowchart of a method for starting an internal combustion engine with a device 101 according to the invention, the said method ensuring that an already existing lock of the movable element 105 or a lock of the movable element 105 produced during the first revolution of the crankshaft is held until the oil pressure within the internal combustion engine has risen to a value which is required for the reliable operation of the device 101. At the commencement of the starting operation, the rotational speed n and the duty factor are equal to zero. As long as the rotational-speed sensor communicates a rotational speed n=zero, the duty factor is held between zero % and the value TV1. When the rotational-speed sensor communicates a rotational speed>zero, the value of an oil-pressure sensor is read out. As long as the value of the oil pressure p is lower than a specific minimum value $p_{min}$ which is necessary in order to operate the device 101 according to the invention reliably, the value of the duty factor is held between zero % and the value TV1. If the oil pressure p overshoots the predetermined pressure, the device 101 goes over to regulated operation, and the duty factor is adjusted between TV3 and 100%, depending on the load state of the engine.

The abovementioned versions are merely examples. The working connections A, B are, of course, interchangeable. The scope of protection is likewise to include devices 101 with mid-position locking of the hydraulic actuation unit 102, in which only one locking pin can engage into a slide piece or a stepped slide piece. Likewise, devices with any locking phase position with one or more locking pins. In the considerations regarding the volume flows and the connections between various connections of the switching valve, pressure losses due to leakage have been ignored.

REFERENCE SYMBOLS

1 Device
1*a* Hydraulic actuation device
2 Stator
3 Rotor
4 Driving wheel
5 Recesses
6 Side wall
7 First side cover
8 Second side cover
9 Connection element
10 Vane slot
11 Vane
12 First pressure chamber
13 Second pressure chamber
14 Slot bottom
15 Leaf-spring element
16 First pressure-medium line
17 Second pressure-medium line
21 First arrow
22 Central bore
23 Shaped-out portions
24 Locking element
25 Axial bore
26 Piston
27 Spring
28 Venting element
29 Slide piece
30 Clearance
101 Device
102 Hydraulic actuation device
103 Control valve
104 Pressure space
105 Element
106 First pressure chamber
107 Second pressure chamber
108 First slide piece
109 Second slide piece
110 First locking pin
111 Second locking pin
112 Actuation unit
113 First spring element
114 Valve body
115 First pressure-medium line
116 Second pressure-medium line
117 Pressure-medium reservoir
118 Pressure-medium pump
119 Filter
120 Non-return valve
121 Third pressure-medium line
122 Fourth pressure-medium line
126 Second arrow
127 First spring
128 Third arrow
129 Second spring
130 Second control position
131 Third control position
132 Fourth control position
133 Retard stop
140 First control position
141 Valve housing
142 Control piston
143 Annular groove
144 Annular groove
145 Annular groove
146 First radial ports
146*a* Second radial ports
147 Second spring element
148 Tappet push rod
149 First limit stop
150 Second limit stop
151 First annular web
152 Second annular web
153 First control edge
154 Second control edge
155 Third control edge
156 Fourth control edge
157 Fourth annular groove
158 Third annular web
P Inflow connection
T Outflow connection
A First working connection
B Second working connection $\phi$ Phase position
$\phi_{mid}$ Locking phase position
X Amount
$Y_1$ Difference angle
$Y_2$ Difference angle
$Y_3$ Difference angle
$TV_{hold}$ Holding duty factor
$p_{min}$ Oil pressure

The invention claimed is:

1. A method for controlling a device for varying the control times of gas exchange valves for an internal combustion engine during the operation of stopping the internal combustion engine, with a hydraulic actuation device which has two reciprocally acting pressure chambers, a phase position ($\phi$) of a camshaft in relation to a crankshaft being capable of being held or varied in a controlled way by means of the supply and discharge of pressure medium to and from the pressure chambers, and with a control valve with two working connections (A, B), with an outflow connection (T) and with an inflow connection (P), the first working connection (A) communicating with the first pressure chamber, the second working connection (B) with the second pressure chamber and the outflow connection (T) with a tank, and the inflow connection (P) being acted upon with pressure medium, the control valve being capable of being brought into four control positions by means of an actuation unit, in a first control position of the control valve, neither the first working connection (A) nor the second working connection (B) communicating with the inflow connection (P), in a second control position of the control valve, the first working connection (A) communicating with the outflow connection (T) and the second working connection (B) communicating with the inflow connection (P), in a third control position of the control valve, the first and the second working connection (A, B) communicating neither with the outflow connection (T) nor with the inflow connection (P), or the first and the second working connection (A, B) communicating solely with the inflow connection (P), in a fourth control position of the control valve, the second working connection (B) counnunicating with the outflow connection (T) and the first working connection (A) communicating with the inflow connection (P), comprising the following method steps that are carried out in the order listed, assumption and holding of a defined phase position $\phi$+X°KW, switch-off of the ignition, setting of the second or fourth control position in order to hold the phase position $\phi$+X°KW until the rotational-speed sensor arrangement communicates the rotational speed n=0, detection of the rotational speed n via a rotational-speed sensor arrangement, holding of an assumed control position for a predetermined timespan, after the expiry of the timespan, deactivation of the actuation unit.

2. A method for controlling a device for varying the control times of gas exchange valves for an internal combustion engine during the operation of starting the internal combustion engine, with a hydraulic actuation device which has two reciprocally acting pressure chambers (107), a phase position ($\phi$) of a camshaft in relation to a crankshaft being capable of being held or varied in a controlled way by means of the supply and discharge of pressure medium to and from the pressure chambers, and with a control valve with two working connections (A, B), with an outflow connection (T) and with an inflow connection (P), the first working connection (A) communicating with the first pressure chamber, the second working connection (B) with the second pressure chamber and the outflow connection (T) with a tank, and the inflow connection (P) being acted upon with pressure medium, the control valve being capable of being brought into four control positions by means of an actuation unit, in a first control position of the control valve, neither the first working connection (A) nor the second working connection (B) communicating with the inflow connection (P), in a second control position of the control valve, the first working connection (A) communicating with the outflow connection (T) and the second working connection (B) communicating with the inflow connection (P), in a third control position of the control valve, the first and the second working connection (A, B) communicating neither with the outflow connection (Q nor with the inflow connection (P), or the first and the second working connection (A, B) communicating solely with the inflow connection (P), in a fourth control position of the control valve, The second working connection (B) communicating with the outflow connection (T) and the first working connection (A) communicating with the inflow connection (P), comprising the following method steps that are carried out in the order listed, setting of the first control position, switch-off of the ignition, detection of the rotational speed n of the crankshaft or of the camshaft, if the rotational speed is n>0: detection of the pressure-medium pressure p, if the pressure-medium pressure p is higher than a predetermined value: setting of control positions according to a characteristic diagram filed in the control unit.

3. A method for controlling a device for varying the control times of gas exchange valves for an internal combustion engine, with a hydraulic actuation device which has two reciprocally acting pressure chambers, a phase position ($\phi$) of a camshaft in relation to a crankshaft being capable of being held or varied in a controlled way by means of the supply and discharge of pressure medium to and from the pressure chambers, and with a control valve with two working connections (A, B), wit an outflow connection (T) and with an inflow connection (P), the first working connection (A) communicating wit the first pressure chamber, the second working connection (B) with the second pressure chamber and the outflow connection (T) with a tank, and the inflow connection (P) being acted upon with pressure medium, the control valve being capable of being brought into four control positions by means of an actuation unit, in a first control position of the control valve, neither the first working connection (A) nor the second working connection (B) communicating with the inflow connection (P), in a second control position of the control valve, the first working connection (A) communicating with the outflow connection (T) and the second working connection (B) communicating with the inflow connection (P), in a third control position of the control valve, the first and the second working connection (A, B) communicating neither with the outflow connection (T) nor with the inflow connection (P), or the first and the second working connection (A, B) communicating solely with the inflow connection (P), in a fourth control position of the control valve, the second working connection (B) communicating with the outflow connection (T) and the first working connection (A) counnunicating with the inflow connection (P), comprising the following method steps that are carried out in the order listed during the stopping operation:

assumption and holding of a defined phase position $\phi+X°KW$, switch-off of the ignition, setting of the second or fourth control position in order to hold the phase position $\phi+X°KW$ until the rotational-speed sensor arrangement communicates the rotational speed $n=0$, detection of the rotational speed n via a rotational-speed sensor arrangement, holding of an assumed control position for a predetermined timespan, after the expiry of the timespan, deactivation of the actuation unit comprising the following method steps that are carried out in the order listed during the starting operation:

setting of the first control position, switch-off of the ignition, detection of the rotational speed n of the crankshaft or of the camshaft, if the rotational speed is $n>0$: detection of the pressure-medium pressure p, if the pressure-medium pressure p is higher than a predetermined value: setting of control positions according to a characteristic diagram filed in the control unit.

* * * * *